United States Patent [19]

Pearl

[11] 4,312,254

[45] Jan. 26, 1982

[54] FLUID JET APPARATUS FOR CUTTING SHEET MATERIAL

[75] Inventor: David R. Pearl, West Hartford, Conn.

[73] Assignee: Gerber Garment Technology, Inc., South Windsor, Conn.

[21] Appl. No.: 840,274

[22] Filed: Oct. 7, 1977

[51] Int. Cl.[3] ..... D06H 7/00

[52] U.S. Cl. ..... 83/177; 83/451; 83/648; 83/658; 83/925 CC

[58] Field of Search ..... 83/177, 53, 451, 648, 83/658, 925 CC; 269/289 R, 296; 30/273, 275

[56] References Cited

U.S. PATENT DOCUMENTS

| | | | |
|---|---|---|---|
| 245,150 | 8/1881 | Fowler | 30/275 |
| 245,152 | 8/1881 | Fowler | 30/275 |
| 2,222,256 | 11/1940 | Deutscher | 83/451 |
| 3,526,162 | 9/1970 | Wilcox | 83/53 X |
| 3,765,289 | 10/1973 | Gerber et al. | 83/925 CC |
| 3,815,221 | 6/1974 | Pearl | 83/925 CC |
| 3,877,334 | 4/1975 | Gerber | 83/177 X |
| 3,927,591 | 12/1975 | Gerber | 83/177 |

*Primary Examiner*—James M. Meister

*Attorney, Agent, or Firm*—McCormick, Paulding & Huber

[57] ABSTRACT

Apparatus for cutting limp sheet material comprises a computer-positioned fluid jet cutting tool supported for movement above and relative to a bed of vertically elongated upwardly projecting members which have pointed free upper ends disposed in a generally common plane to define a fluid permeable sheet material supporting surface. The bed has fluid passageways therethrough which communicate with a fluid collection chamber therebelow. Vacuum apparatus independent of the fluid collection chamber is provided for normalizing or compressing a lay-up of limp sheet material resting on the supporting surface so that the individual sheets which comprise the lay-up collectively assume the characteristics of a rigid solid mass.

21 Claims, 5 Drawing Figures

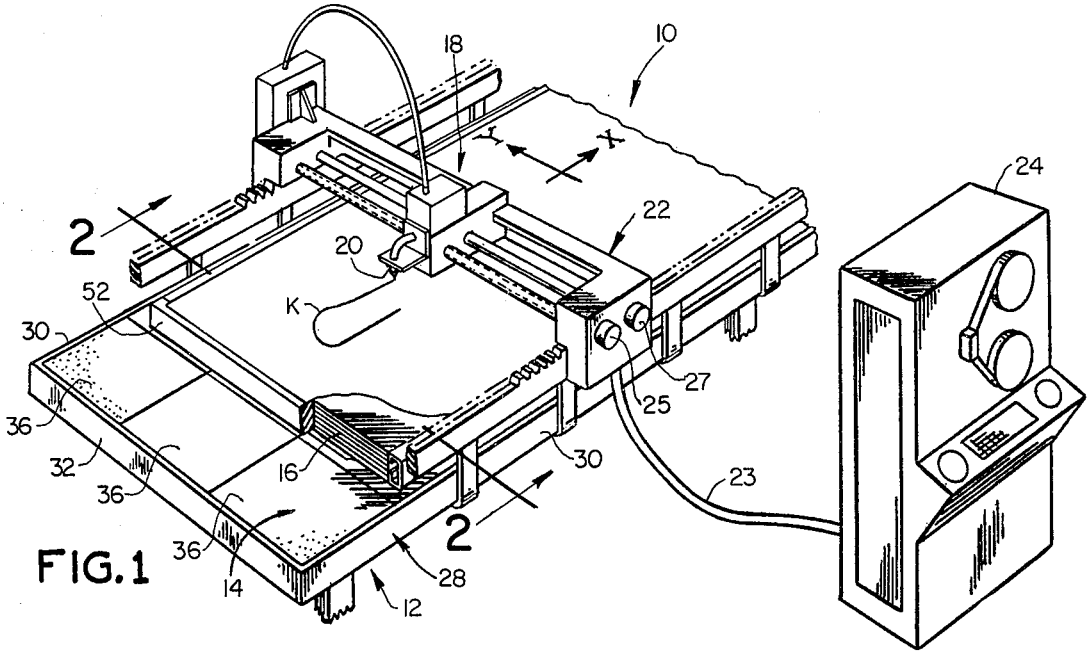
FIG. 1
FIG. 2
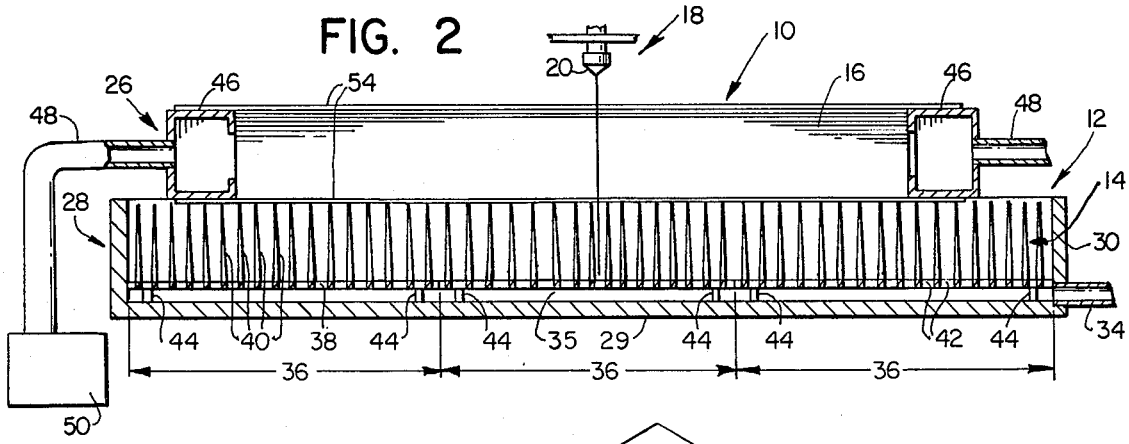
FIG. 3
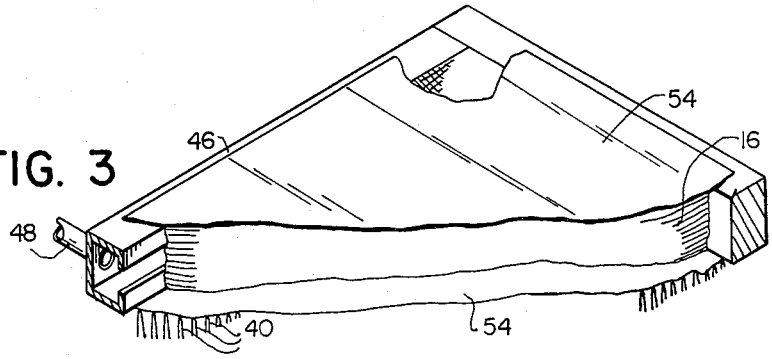

FLUID JET APPARATUS FOR CUTTING SHEET MATERIAL

BACKGROUND OF THE INVENTION

This invention relates in general to apparatus for cutting sheet material and deals more particularly with improved high velocity fluid jet cutting apparatus for automated production cutting of limp sheet materials such as fabrics, plastic, paper, leather, rubber and the like. In an apparatus of the aforedescribed general type, a high pressure fluid jet focused by a nozzle functions as an omnidirectional cutting "blade" which forms a narrow kerf. Such apparatus is particularly suitable for cutting intricate shapes from multi-ply materials, however, the high pressure fluid jet stream, which travels at supersonic speed as it leaves the nozzle of the cutting tool, necessarily contains considerable energy as it exits from material which it has cut even though the stream energy has been dissipated significantly in the cutting process. This residual energy poses a potential source of damage to the apparatus, and particularly the working surface which supports the material being cut, and generally must be dissipated before the cutting fluid can be collected to be recirculated within the apparatus or drained from it.

In an apparatus of the aforedescribed general type the sheet material cut by the fluid jet is usually compressed, at least in the region where the jet is operating. More specifically, compressive forces are applied to the sheet material in a direction generally normal to the plane of the material and the support surface on which it rests. A typical apparatus of the aforedescribed general type wherein air is evacuated from between the layers of material which comprise a lay-up to normalize or compress the lay-up into a hardened mass is illustrated and described in U.S. Pat. No. 3,877,334, issued to the Assignee of the present invention. This patent discloses apparatus which has a common vacuum-fluid collection chamber. While such apparatus is generally satisfactory, it has been found that air entrained in the fluid jet stream and entering the collection chamber tends to reduce the efficiency of the vacuum system and the normalizing or compressing efficiency of the apparatus.

It is a general aim of the present invention to provide an improved fluid jet cutting apparatus which includes improved means for supporting material to be cut to provide for retardation and dissipation of cutting jet energy after the jet exits from the material which has been cut. It is a further aim of the present invention to provide an improved fluid jet cutting apparatus which includes vacuum means for compacting or compressing a multi-ply lay-up of sheet material so that the lay-up reacts substantially as a solid, rigid body in response to the cutting action of the fluid jet.

SUMMARY OF THE INVENTION

In accordance with the present invention, apparatus for cutting sheet material comprises a bed which includes a base which has a multiplicity of fluid passageways therethrough. A multiplicity of vertically elongated members project upwardly from the base and have pointed free upper end portions disposed in a common plane to define a fluid permeable sheet material supporting surface. A fluid jet cutting tool mounted above the supporting surface has a jet nozzle directed toward the supporting surface to impinge a high velocity jet of cutting fluid upon sheet material supported on the surface. A controlled positioning means moves the fluid jet cutting tool relative to the supporting surface whereby to cut sheet material supported on the surface. In accordance with a further aspect of the invention means is provided for drawing a vacuum on a lay-up side surface, defined by the edges of stacked sheets which comprise the lay-up, whereby to compress at least a portion of the lay-up in a vertical direction.

BRIEF DESCRIPTION OF THE DRAWINGS

FIG. 1 is a perspective view of a computer-positioned fluid jet cutting apparatus for cutting sheet material and embodying the present invention.

FIG. 2 is a somewhat enlarged sectional view taken along the line 2—2 of FIG. 1.

FIG. 3 is a somewhat enlarged fragmentary perspective view of the apparatus of FIG. 1.

DETAILED DESCRIPTION OF PREFERRED EMBODIMENTS

Figure 5:
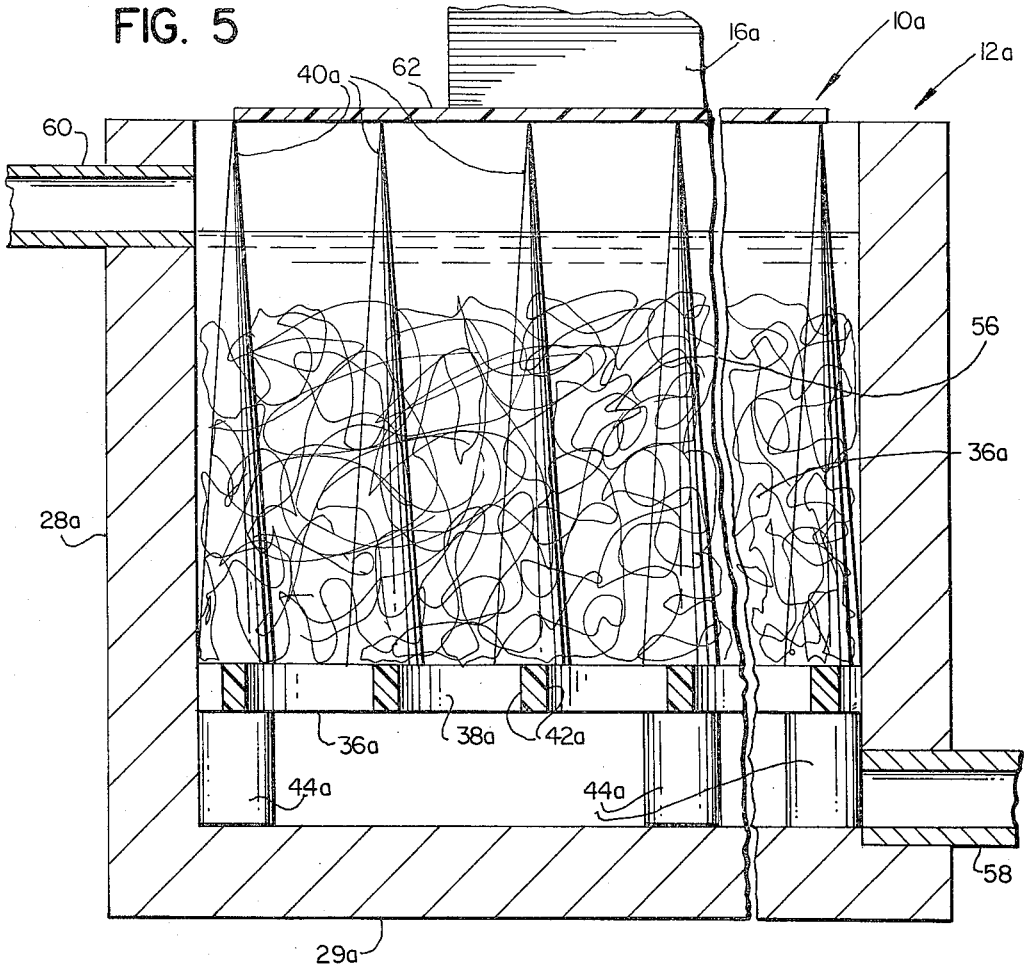
FIG. 5 is a fragmentary transverse sectional view and shows the bed of another apparatus embodying the invention.

Referring now to the drawing and more particularly to FIG. 1, a fluid jet cutting apparatus embodying the present invention is indicated generally by the reference numeral 10. The apparatus 10 is particularly adapted for automated production cutting of sheet material and comprises a cutting table, indicated generally by the numeral 12, which includes a bed of horizontally spaced apart vertically elongated and upwardly extending members which have pointed free upper ends generally disposed in a common plane to define a material support surface. The illustrated bed is designated generally at 14. A lay-up of limp sheet material, indicated by the numeral 16, which comprises a plurality of sheets of fabric or like material supported in vertically stacked relation, is shown resting on the bed 14. The apparatus 10 further includes a high velocity fluid jet cutting mechanism, indicated generally at 18, which has a jet nozzle 20 mounted on a moveable carriage assembly designated generally by the numeral 22. The carriage assembly is supported on the cutting table 12 to move the nozzle 20 in longitudinal and transverse coordinate directions, as indicated by the X and Y coordinate axes, shown in FIG. 1. The jet nozzle 20 produces a high velocity fluid cutting jet, which impinges upon the lay-up 16 to form a kerf K and moves in cutting engagement with it to cut patterns from the lay-up in response to control signals received from a programmable computer 24. More specifically, the illustrated computer 24 reads digital data from a program tape and transmits electrical control signals to the carriage assembly 22 through a control cable 23 to operate drive motors 25 and 27 which rotate lead screws to drive the carriage assembly 22 relative to the table 12 and to move the jet nozzle 20 relative to the carriage assembly. The illustrated apparatus 10 also includes a vacuum device designated generally by the numeral 26, for compressing the lay-up supported on the cutting table in a vertical direction, so that the individual limp sheets of fabric or the like, which comprise the lay-up, react collectively and assume the characteristic of a rigid solid mass which may be efficiently cut by the fluid jet stream which eminates from the nozzle 20.

Considering now the apparatus 10 in further detail, the cutting table 12 includes a generally rectangular upwardly opening base container 28 which has a bottom wall 29, side walls 30, 30, and opposite end walls 32, 32 (one shown). A fluid drain connection 34 associated with the right hand sidewall 30, as it appears in FIG. 2, communicates with a fluid collection chamber or receiver 35, defined by the base container 28, for a purpose which will be hereinafter further discussed.

Figure 4:
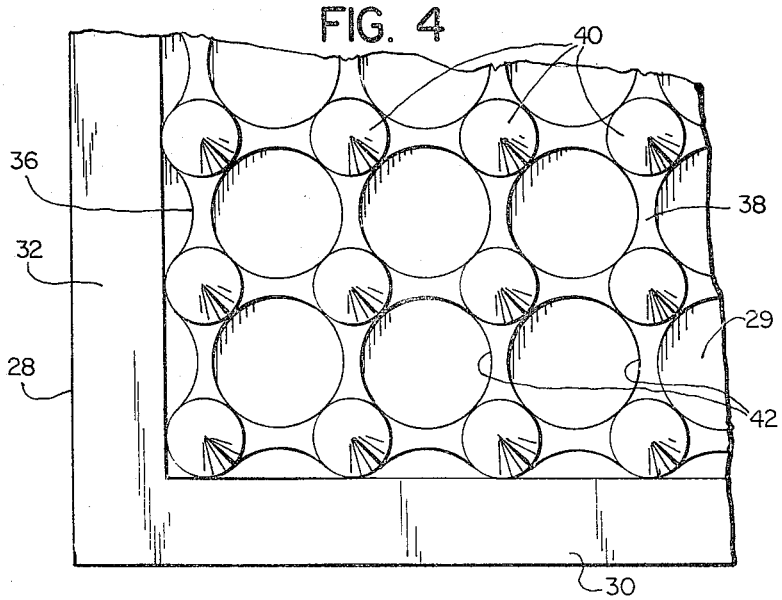
FIG. 4 is a somewhat enlarged fragmentary plan view of the bed.

The elongated members which form the bed may, for example, comprise rigid pins or spikes or resilient flexible bristles and may be made from metal, plastic or other suitable materials. However, the illustrated bed 14 preferably comprises a bristle bed which includes a plurality of individual bristle blocks 36, 36 arranged in contiguous relation within the base container 28, substantially as shown in FIG. 1. A typical bristle block 36, is preferably molded from plastic material and has a generally rectangular base portion 38 and a multiplicity of vertically elongated members or bristles 40, 40 integrally connected to the base portion and which project upwardly therefrom. Preferably, each bristle has a generally circular cross section, is upwardly tapered, and converges to a point at its free upper end. The bristles 40, 40 are arranged in uniformly spaced relation on the base 38. A multiplicity of fluid passageways 42, 42 extend through the base 38 intermediate the bristles 40, 40. In the illustrated embodiment each fluid passageway 42 has a generally circular cross section, as viewed from above and as shown in FIG. 4. The minor transverse cross sectional area of each passageway 42 is substantially greater than the major cross sectional area of each of said bristles 40, 40. More specifically, the minor diameter of each passageway 42 is substantially greater than the major diameter of each bristle 40. Thus, each bristle 40 is connected to an adjacent bristle 40 by a relatively thin web which comprises a part of the base 38. Each bristle block 36 has a plurality of integral spaced apart feet 44, 44 which project downwardly from its base portion 38. The feet 44, 44 may comprise downwardly projecting ribs or posts which serve to support the bristle block with its base 38 spaced above the bottom wall 29 of the base container. The various bristle blocks 36, 36 which form the bristle bed 14 are or may be anchored within the base container 28 by suitable means (not shown).

The fluid jet cutting mechanism 18 is of a type well known in the art and has the jet nozzle 20 and suitable hydraulic pressurizing mechanism for delivering a steady stream of cutting fluid under pressure to the nozzle 20. More specifically, the fluid jet cutting apparatus 18 may comprise an intensifier pump (not shown) for delivering fluid under pressure and a pressure smoothing accumulator (not shown) which smooths the pressure pulsations from the pump to supply pressure fluid to the cutting nozzle 20 at a substantially constant pressure value which may, for example, be in the range from 10,000 psi to 100,000 psi. A typical nozzle may, for example, have a throat aperture in a range of 0.004 inches to 0.016 inches so that an extremely fine high velocity stream eminates from the nozzle and is capable of penetrating and cutting through the lay-up 16, even after the lay-up has been compressed to a substantially rigid condition.

The vacuum device of the present invention includes at least one elongated vacuum channel connected by a conduit 48 to a suitable vacuum pump 50 for drawing a vacuum on at least a portion of one vertical surface of the lay-up, the latter vertical surface being defined by the edges of the stacked sheets of material which comprise the lay-up 16. However, in accordance with the presently preferred construction, the vacuum device 26 has two vacuum channels 46, 46 for engaging the opposite vertical side surfaces of the lay-up. Each vacuum channel 46 is connected to the vacuum pump 50 by an associated conduit 48. The vacuum device 26 also includes two elongated sealing members 52, 52 (one shown) for engaging and sealing the vertical end surfaces defined by the opposite ends of the rectangular sheets which comprise the lay-up 16. If the vacuum channels 46, 46 have open ends, sealing members 52, 52 may be constructed and arranged to seal these open ends substantially as shown in FIGS. 1 and 3.

If the sheet material which comprises the lay-up 16 is an air permeable material, such as cloth, the lay-up may be sandwiched between sheets of expendable air impervious material, as for example, sheets of polyethylene film such as indicated at 54, 54 in FIG. 2. These sheets of expendable film prevent air from being drawn into the lay-up from the atmosphere and enable the lay-up to be compressed more firmly into a substantially rigid mass when air is evacuated therefrom by the vacuum device 26. When such expendable sheets of air impervious material are used, the upper sheet 54 may be draped over the opposite ends of the lay-up to seal the opposite ends, thereby eliminating the need for elongated sealing members such as hereinbefore described. Such air impervious sheet material may also be used to seal irregularly shaped opposite ends of a lay-up such as may result when irregularly shaped patterns are cut from the lay-up.

The kerf K is formed in the compressed lay-up 16 as the jet nozzle 20 moves along its programmed path in response to signals received from the computer 24. The cutting action of the fluid jet stream results from the jet impinging upon and shattering or ripping through the material which compresses the lay-up. The limp sheet materials are compressed into a hardened condition by application of vacuum so that the individual sheet material plies cannot flutter or be displaced by the jet and are collectively subjected to the full fracturing force of the jet, reacting in the manner of a solid material. The resulting compressive force exerted on the lay-up by the atmosphere prevents the individual sheets of material from shifting laterally relative to each other so that work pieces of uniform size and shape are produced by the cutting operation.

If the desired uniformity of cut is to be achieved it is essential that the fluid cutting jet have considerable remaining energy as it emerges from the lowermost ply of the lay-up. This residual energy poses a potential source of damage to the apparatus and particularly the lay-up supporting surface. However, when the fluid cutting jet impinges directly upon the pointed end of the bristle it tends to be dispersed or scattered by the bristle which results in a substantial dissipation of jet energy without serious risk of bristle damage. The tapered shape of each bristle causes the fluid jet to impinge upon each bristle at a relatively small angle of incidence. The resulting deflection of either or both the flexible bristle and the fluid jet stream results in a further defusion and dissipation of jet energy. The cutting jet stream travels a significant distance in passing through the bed which results in further loss of its energy. Air entrained within the jet stream tends to pressurize the fluid collection chamber 35. However, since the vacuum system 26 for normalizing the lay-up is wholly independent of the fluid collection chamber, pressurization of the latter chamber has no detrimental effect upon operation of the apparatus. In fact, in the present apparatus pressurization of the fluid collection chamber or receiver 35 is advantageous. Pressurized air in the collection receiver 35 tends to act as an air cushion to further retard the fluid jet entering the receiver thereby reducing the risk of jet damage to the walls of the receiver. Cutting fluid is collected within the receiver 35 and passes into the conduit 34 and for recirculation within the system or discharge to a suitable drain. However, if an expendable cutting fluid, such as water, is used the apparatus may be arranged to discharge waste water directly to a floor drain opening or the like, immediately below the apparatus, thereby eliminating need for a fluid receiver such as aforedescribed.

Referring now to FIG. 5, another apparatus embodying the invention is illustrated and indicated generally by the reference numeral 10*a*. The apparatus 10*a* is similar in many respects to the apparatus 10 previously described, but includes further means for absorbing energy from a cutting fluid jet stream and controlling splash back from the latter stream to prevent the stream from damaging either the apparatus or the material being cut. Parts of the apparatus shown in FIG. 5 which generally correspond to parts previously described bear the same reference numeral as the previously described structure and a letter "a" suffix and will not be hereinafter further described in detail.

The apparatus 10*a* has a table indicated generally at 12*a* which includes a base container 28*a* and a bed 14*a* supported within the base container. The bed is or may be formed from a plurality of individual blocks 36*a*, 36*a* arranged in adjacent side-by-side relation within a base container 28*a*. Each block 36*a* has a base portion 38*a* and a multiplicity of pins or spikelike members 40*a*, 40*a* which project upwardly from the base. The latter members may be integrally formed with or otherwise connected to the base portion 38*a* and are tapered, as previously described, and have sharply pointed upper ends which are generally disposed within a common plane to define a horizontal fluid permeable sheet material supporting surface. A mass of entangled wire or metal wool, indicated by the numeral 56, disposed within the base container 28*a* in spaces between the pins 40*a*, 40*a* and which generally surrounds the pins is provided for absorbing energy from a high velocity fluid jet cutting stream which eminates from a nozzle (not shown) positioned above the table 12*a*. However, it should be understood that other loosely packed energy absorbing materials may be used in place of metal wool. Further, the base container 28*a* may be filled to a level below the material supporting surface with an energy damping liquid, and the metal wool 56 at least partially immersed in the damping liquid. Fluid inlet and outlet conduits indicated at 58 and 60, respectively, communicate with the interior of the base container 28*a* and cooperate to maintain the surface energy damping liquid below the sheet material supporting surface, defined by the pointed upper ends of the pins 40*a*, 40*a*.

When the apparatus 10*a* is used to cut cloth or like material, a sheet of expendable waterproof material 62, such as polyethylene plastic, is positioned on the material supporting surface and acts as a barrier layer between the cutting table 12*a* and a lay-up, such as indicated at 16*a*, which rests on the waterproof sheet 62. As the cutting nozzle moves in response to a program and relative to the table in cutting relation with the lay-up 16*a*, the high velocity fluid jet cutting stream which eminates from the nozzle 20*a* (not shown) passes through the layup 16*a* and the expendable sheet 62 and into the base container 28*a*. The jet noise and back splash energy from the cutting jet are dissipated by the metal wool and or, the damping liquid in the base container. The layer of expendable waterproof material 62 on which the cloth lay-up 16*a* is supported serves to keep the lay-up dry.

I claim:

1. Apparatus for cutting sheet material comprising a bed including a base having a multiplicity of axially vertically elongated and horizontally spaced apart members projecting upwardly therefrom and a multiplicity of fluid passageways extending therethrough between said members, said members having free upper ends disposed in a common plane and defining a fluid permeable sheet material supporting surface, a fluid jet cutting tool mounted above said supporting surface and including a jet nozzle directed toward said fluid permeable supporting surface to impinge a high velocity jet of cutting fluid upon sheet material supported on said fluid permeable supporting surface, and controlled positioning means for moving said fluid jet cutting tool relative to said fluid permeable supporting surface with said jet nozzle directed toward said fluid permeable supporting surface.

2. Apparatus for cutting sheet material as set forth in claim 1 wherein each of said members has a pointed free upper end and a taper extending throughout the entire length thereof and converging upwardly from said base to said pointed free upper end.

3. Apparatus for cutting sheet material as set forth in claim 2 wherein said members comprise flexible bristles.

4. Apparatus for cutting sheet material as set forth in claim 2 wherein said members comprise rigid pins.

5. Apparatus for cutting sheet material as set forth in claim 1 including a fluid collection chamber below said bed and communicating with said fluid passageways for receiving cutting fluid therefrom.

6. Apparatus for cutting sheet material as set forth in claim 5 wherein said bed includes a base container, said base and said members are received and supported within said base container, and said base and said base container cooperate to define said fluid collection chamber.

7. Apparatus for cutting sheet material as set forth in claim 6 wherein said bed includes fluid energy absorbing means in said base container below said sheet material supporting surface in surrounding relation to said members and in the path of said high velocity stream for absorbing energy from said stream.

8. Apparatus for cutting sheet material as set forth in claim 7 wherein said fluid energy absorbing means comprises a quantity of fluid energy damping liquid in said base container and fluid energy absorbing material at least partially disposed within said damping liquid.

9. Apparatus for cutting sheet material as set forth in claim 5 wherein said sheet material comprises a lay-up of vertically stacked sheets and said apparatus includes means for compressing the lay-up in at least the region of the material surrounding the cut formed by said jet cutting apparatus.

10. Apparatus for cutting sheet material as set forth in claim 1 wherein said members comprise bristles and said bed comprises a plurality of individual bristle blocks.

11. Apparatus for cutting sheet material as set forth in claim 10 wherein each of said bristle blocks is molded from plastic and has a base element which forms a portion of the base of said bed and a multiplicity of bristles integrally connected to said base element and projecting upwardly therefrom.

12. Apparatus for cutting sheet material as set forth in claim 11 wherein each of said bristles has a taper converging upwardly from said base element toward its free upper end.

13. Apparatus for cutting sheet material as set forth in claim 1 wherein said members are integrally connected to said base.

14. Apparatus for cutting sheet material as set forth in claim 1 wherein said base comprises a plurality of thin webs, each of said members being connected to an adjacent one of said members by one of said webs, said webs defining said passageways.

15. Apparatus for cutting sheet material as set forth in claim 7 wherein said fluid energy absorbing means comprises a quantity of fluid energy damping liquid within said base container.

16. Apparatus for cutting a layup of sheet material as set forth in claim 1 wherein said members comprise resilient flexible bristles.

17. Apparatus for cutting a layup of sheet material formed by a plurality of limp sheets of material arranged in vertically stacked relation and comprising a cutting table having a bed including a base and a multiplicity of vertically elongated and horizontally spaced apart members projecting upwardly from said base, said members having free upper end portions disposed in a common plane and defining a fluid permeable working surface for supporting a layup spread thereon, said base having fluid passageways therethrough intermediate said members, a fluid receiver below said working surface and said bed, said fluid passageways providing fluid communication between said working surface and said fluid receiver, a fluid jet cutting tool mounted above said working surface and having a jet nozzle directed towards said working surface for discharging a high velocity jet of cutting fluid toward said working surface and the layup spread thereon, controlled drive means for effecting relative movement between said fluid jet cutting tool and said working surface, and means for drawing a vacuum on at least a portion of one vertical surface of the layup defined by edges of stacked sheets which comprise the layup supported on said working surface to compress at least a portion of the layup in a vertical direction.

18. Apparatus for cutting a layup of sheet material as set forth in claim 17 wherein said members comprise bristles.

19. Apparatus for cutting a layup of sheet material as set forth in claim 17 wherein said members comprise rigid pins.

20. Apparatus for cutting a layup of vertically stacked sheets of material comprising a bed including a base, a multiplicity of axially vertically elongated and horizontally spaced apart members projecting upwardly therefrom and a multiplicity of fluid passageways extending therethrough between said members, said members having free upper ends disposed in a common plane and defining a fluid permeable sheet material supporting surface, a fluid jet cutting tool mounted above said supporting surface and including a jet nozzle directed toward said fluid permeable supporting surface to impinge a high velocity jet of cutting fluid upon sheet material supported on said fluid permeable supporting surface, controlled positioning means for moving said fluid jet cutting tool relative to said fluid permeable supporting surface with said jet nozzle directed toward said fluid permeable supporting surface, a fluid collection chamber below said bed and communicating with said fluid passageways for receiving cutting fluid therefrom, and means independent of said fluid chamber for drawing a vacuum on said layup and compressing said layup at least in the region of the material surrounding the cut formed by said jet cutting apparatus.

21. Apparatus for cutting sheet material comprising a bed including a base having a multiplicity of axially vertically elongated and horizontally spaced apart members projecting upwardly therefrom and a multiplicity of fluid passageways extending therethrough between said members, a base container, said base and said members being received and supported within said base container, said base and said base container cooperating to define a fluid collection chamber below said bed and communicating with said fluid passageways said members having free upper ends disposed in a common plane and defining a fluid permeable sheet material supporting surface, a fluid jet cutting tool mounted above said supporting surface and including a jet nozzle directed toward said fluid permeable supporting surface to impinge a high velocity jet of cutting fluid upon sheet material supported on said fluid permeable supporting surface, controlled positioning means for moving said fluid jet cutting tool relative to said fluid permeable supporting surface with said jet nozzle directed toward said fluid permeable supporting surface, and fluid energy absorbing means in said base container below said sheet material supporting surface in surrounding relation to said members and in the path of said high velocity jet of cutting fluid for absorbing energy from said jet of cutting fluid, said fluid energy absorbing means comprising a quantity of fluid energy damping liquid in said base container and metal wool at least partially disposed within said damping liquid.

* * * * *